US006004398A

United States Patent [19]

Eaton et al.

[11] Patent Number: 6,004,398

[45] Date of Patent: Dec. 21, 1999

[54] CLEANING TEXTILE MACHINES

[75] Inventors: David Charles Eaton, Buxton; Colin Atkinson, Colne; Carl Phythian, Wilmslow, all of United Kingdom

[73] Assignee: Rieter Scragg Limited, United Kingdom

[21] Appl. No.: 09/002,035

[22] Filed: Dec. 31, 1997

[30] Foreign Application Priority Data

Jan. 10, 1997 [GB] United Kingdom ..... 9700432

[51] Int. Cl.[6] ..... B01J 19/08

[52] U.S. Cl. ..... 134/1; 134/15; 134/32; 134/42

[58] Field of Search ..... 134/1, 15, 32, 134/42

[56] References Cited

U.S. PATENT DOCUMENTS 4,292,770 10/1981 Newton, Jr. ..... 51/170 PT
5,254,831 10/1993 Seki ..... 219/121.64
5,262,617 11/1993 Higashiguchi ..... 219/221
5,367,141 11/1994 Piltea ..... 219/121.67
5,881,886 3/1999 Lawandy ..... 209/3.3

*Primary Examiner*—Jill Warden
*Assistant Examiner*—S. Carrillo
*Attorney, Agent, or Firm*—Burns, Doane, Swecker & Mathis

[57] ABSTRACT

Cleaning of a textile machine or part of such a machine is effected by directing a laser beam at the part to be cleaned for an appropriate length of time. This may be done with the part in situ in its normal operating position in the machine, and the machine may be run in its normal operating condition, possibly with the yarn running to avoid machine down time. Alternatively, the operation may include moving the yarn to a substitute part whilst the original part is cleaned, or moving a substitute part into the normal operating position whilst the part to be cleaned is moved to a cleaning position. A lens system may direct a parallel beam to the part to be cleaned from a remote location, or a fiber optic cable may extend near to that part to guide the laser beam to it.

7 Claims, 3 Drawing Sheets

FIG. 2
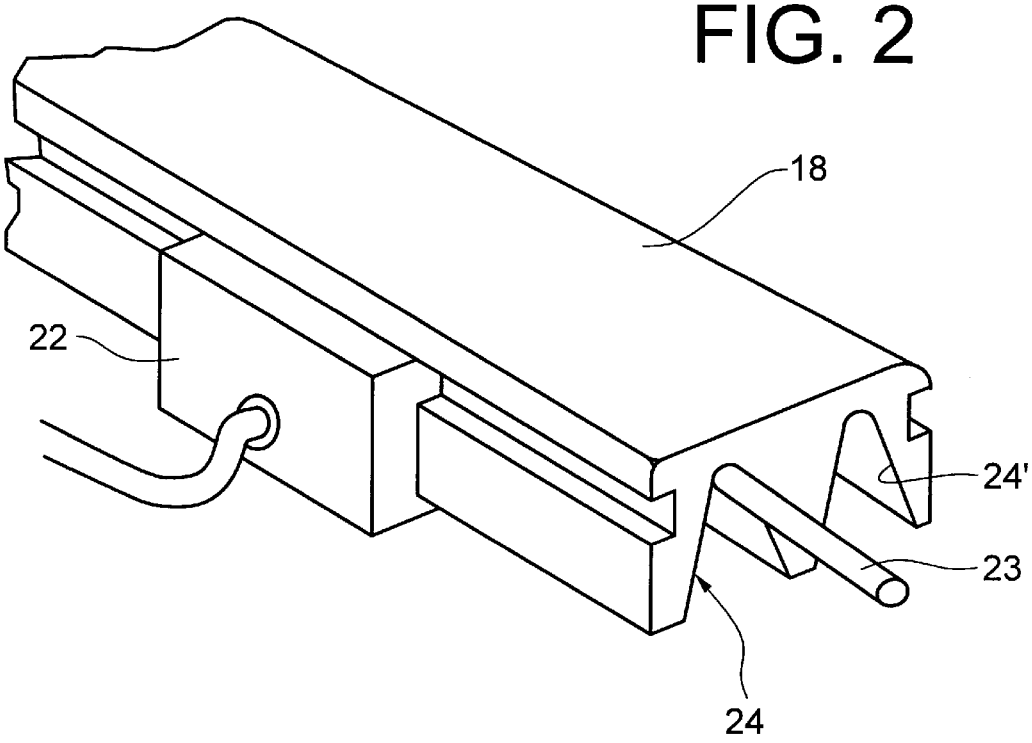
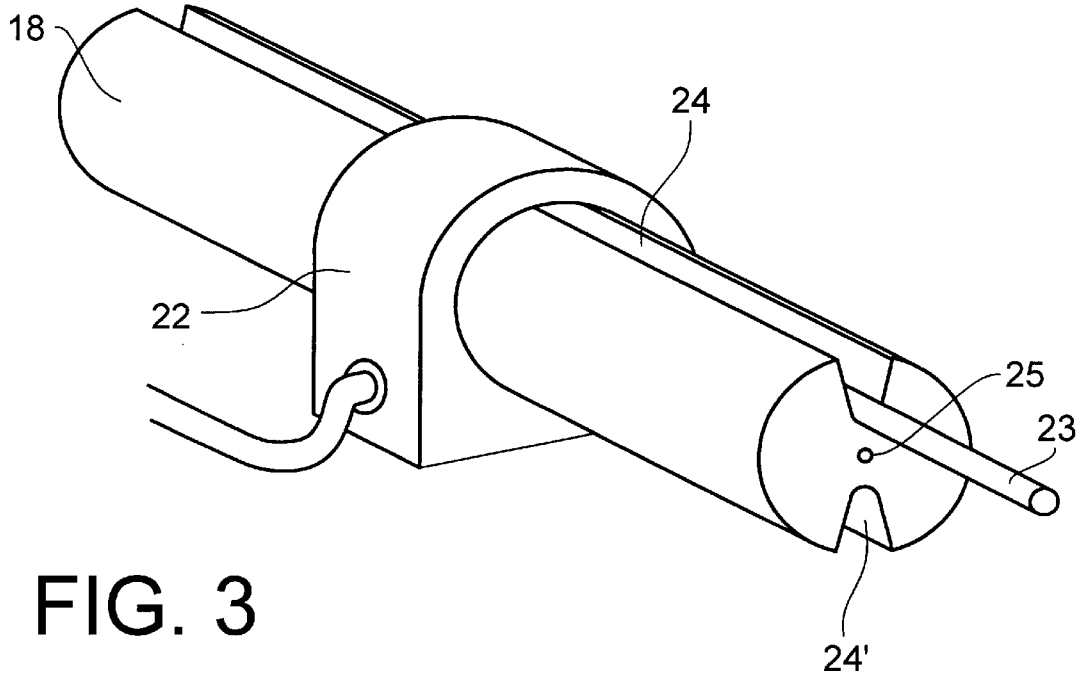
FIG. 3

CLEANING TEXTILE MACHINES

FIELD OF THE INVENTION

This invention relates to the cleaning of textile machines.

BACKGROUND OF THE INVENTION

Many parts of textile machines become contaminated over a period with an accumulation of yarn debris and/or deposits of oils. In order that the quality of the yarn being processed is not compromised, it is necessary to clean the contaminated parts of the machines at regular intervals. A particular part may be cleanable in situ on the machine, or the cleaning may require the removal of the part from the machine. In either case it is usually necessary to stop the processing of the yarn, and it may be necessary to stop the machine and remove the part from the machine. This results in the loss of production time, which can be an appreciable cost to the yarn processor. The machine down-time is particularly lengthy in the case of machines having heaters that must be allowed to cool before they can be cleaned, and then must be raised in temperature before the yarn processing can be resumed. Because of this problem, it is commonplace to extend the periods between machine cleanings to the maximum possible, and this can result in considerable quantities of processed yarn whose quality is not as high as it would be if machine cleaning was more frequent. Furthermore, the methods of cleaning currently practiced using brushes and/or solvents may damage the surfaces of the machine parts and are unreliable, both of which can also lead to the production of processed yarn of lesser quality.

OBJECT OF THE INVENTION

It is an object of the present invention to provide a method of, and apparatus for, cleaning a textile machine that overcomes at least to a large extent the disadvantages of the methods of machine cleaning currently in use.

SUMMARY OF THE INVENTION

The invention provides a method of cleaning a textile machine, comprising directing a laser beam at a part to be cleaned of the machine for a time sufficient to clean the part. The cleaning method may comprise directing the beam at the part to be cleaned whilst the part is disposed in the machine, preferably in its normal operating position. The method may comprise operating the machine in its normal operating condition whilst effecting the cleaning of the part.

The cleaning method may comprise moving the part to be cleaned from an operating position to a cleaning position prior to directing the laser beam at the part. In that case the method may comprise moving a substitute part from a cleaning position to the operating position when the part to be cleaned is moved from the operating position to its cleaning position. Alternatively the method may comprise moving material being processed on the machine from the part to be cleaned to the substitute part prior to directing the laser beam at the part to be cleaned.

The method may comprise directing the laser beam in a direction substantially perpendicular to a surface of the part. The cleaning method may comprise moving the laser beam or the surface relative to one another.

The invention also provides a textile machine, and apparatus for cleaning the machine comprising a cleaning device operable to direct a laser beam at a part of the machine for a time sufficient to clean the part.

The part may be disposed in the machine whilst the cleaning is effected, and may be in its normal operating position. The machine may be in its normal operating condition. The part to be cleaned may be movable from its operating position to a cleaning position. In this case the machine may comprise a substitute part located adjacent the part to be cleaned, and the substitute part may be movable from a cleaning position to the operating position when the part to be cleaned is moved from the operating position to its cleaning position. The cleaning device may be disposed to direct the laser beam in a direction perpendicular to a surface of the part. Either the cleaning device or the part to be cleaned may be movable relative to the other whilst the cleaning is effected. The cleaning device may be secured to the machine whilst the laser beam is directed at the part to clean the part, and may be operable only when so secured. The cleaning device may comprise a lens arrangement adapted to direct a substantially parallel laser beam at the part to be cleaned, or a fibre optic cable operable to direct the laser at the part. In this case the cleaning device may also comprise a blowing device operable to direct a jet of air at the end of the fibre optic cable adjacent the part to be cleaned.

The laser beam may be a $CO_2$, Nd:YAG or Excimer laser. The wavelength of the laser beam may chosen to suit the material of the part to be cleaned and/or the material to be removed from the part, and may be in the region of 1.064 $\mu$m or 0.532 $\mu$m. The laser beam may be a pulsed beam, and the pulses may have a duration of between 5 and 30 nSec. The number of pulses may be between 5 and 120 per second, and the average power may be between 5 and 25 W.

BRIEF DESCRIPTION OF THE DRAWINGS

The invention will now be further described with reference to the accompanying drawings in which:

FIG. 2 is an enlarged view of one embodiment of heater and cleaning device FIG. 3 is an enlarged view of a second embodiment of heater and cleaning device.

DESCRIPTION OF THE PREFERRED EMBODIMENTS

Figure 1:
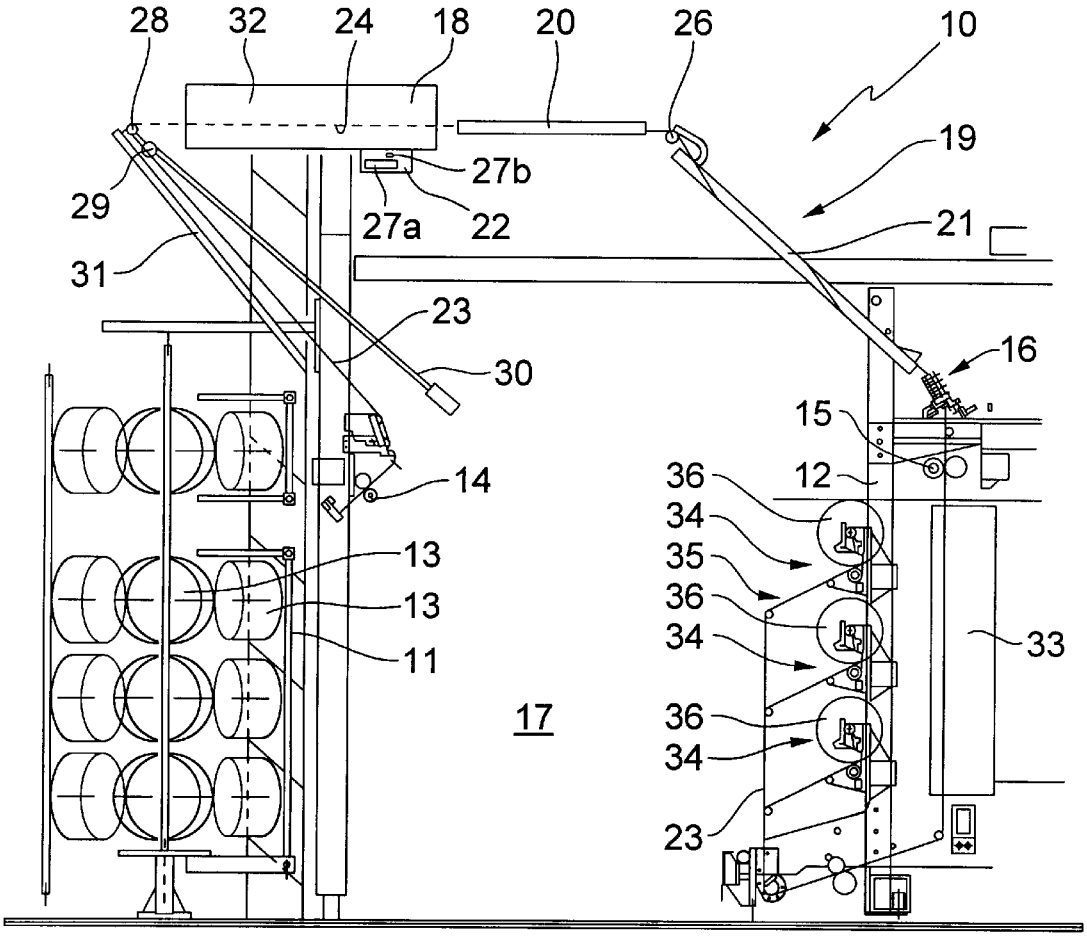
FIG. 1 is an elevation of a textile machine having a cleaning device for cleaning heaters

Referring now to FIG. 1, there is shown a textile machine 10 for false twist texturing a yarn 11. The machine 10 comprises a creel 11, a main frame 12, a first feed device 14, a second feed device 15, a false twist device 16, an operator's aisle 17 between the creel 11 and the main frame 12, a first heater 18 and a cooling zone 19 in which there are cooling plates 20, 21. A yarn 23 is fed from a supply package 13 mounted in the creel 11, in sequence through the first feed device 14, the first heater 18, the cooling zone 19, the false twist device 16 and an optional second heater 33 to a take-up package 36 mounted in a cradle 34 in the take-up zone 35. To guide the yarn 23 from the first feed device 14 to the upstream end 32 of the heater 18, there is a yarn guide 28 mounted on a sledge 29 that is movable along a track 31 by means of a rod 30 from a threading position adjacent the first feed device 14 to a processing position adjacent the end 32 of the heater 18. During threading the yarn 23 runs in a substantially straight line from the first feed device 14 to the guide 26 between the cooling plates 20, 21, out of contact with the heater 18 and cooling plate 20.

The yarn 23 runs over various surfaces of the textile machine 10, for example the feed devices 14, 15, the cooling plates 20, 21, the false twist device 16 and the yarn guides 28, 26. In addition the yarn may run in contact with the surfaces of the heaters 18, 33. This can cause deposits of yarn debris to accumulate on those surfaces. In addition, since the supply yarn 23 invariably has yarn processing oil on it, deposits of the oil may accumulate on some of the surfaces, in particular that of the heater 18. In order that the quality of the processed yarn is not to deteriorate to an unacceptable level, it is necessary to clean the abovementioned surfaces from time to time. Conventionally this is done by brushing by hand, using various cleaning substances such as detergents. This may be done with the part to be cleaned in situ on the machine 10, but in many cases the part has to be removed from the machine 10 for the cleaning process to be performed. In either case the machine 10 must be stopped, and this represents costly non-productive time for the machine user. The problem is particularly acute in the case of heater cleaning due to the time taken for the heaters 18, 33 to cool from their operating temperatures and to regain those temperatures after cleaning.

However in the present case there is a cleaning device 22 secured to the heater 18. The cleaning device 22 comprises a laser beam generating device 27*a* operable to direct a laser beam from outside the heater 18 through the structure of the heater 18 in a direction substantially perpendicular to the surface 24 in contact with or adjacent which the yarn 23 runs when being processed. The cleaning device 22 is movable longitudinally of the heater 18 in order that the whole of the surface 24 may be cleaned. The beam is directed upwardly away from the operator's aisle 17, thereby avoiding any risk to an operator. The laser beam is formed by the generator 27*a* and a lens arrangement 27*b* to be substantially parallel, and may be a $CO_2$, Nd:YAG or Excimer laser. The beam may have a wavelength chosen to suit the material of the surface 24 and/or the material to be removed from that surface, and may be in the region of 1.064 $\mu$m or 0.532 $\mu$m. The beam is pulsed with a pulse duration of between 5 and 30 nSec. The number of pulses is between 5 and 120 per second, and the average power is between 5 and 25 W. The effect of the beam is to turn the outer layers of the deposited material on the surface 24 into a plasma and create vibrationary shock waves through the deposit, which are reflected by the surface 24 and interfere with the next pulse to break up the deposit so that it falls away from the surface 24.

Dependent upon the type of yarn 23 being processed, it may be possible to clean the heater 18 with the yarn 23 still running, thereby reducing machine down-time to zero. If this is not possible, this cleaning process may be performed with the yarn 23 moved out of contact with the heater 18 and cooling plate 20 by lowering the sledge 29. However, the heater 18 can still be at an elevated temperature and preferably at its operating temperature. By this means the overall down time of the machine 10 is considerably reduced by comparison with currently used cleaning methods. Alternatively, if the heater may be cleaned with the heater 18 at its normal operating temperature, a substitute surface 24' may be provided as shown in FIG. 2. In this case the heater 18 has two heating surfaces 24, 24', which run parallel with each other longitudinally of the heater 18 and both of which are at the operating temperature. The yarn 23 is shown running in contact with the surface 24. When the surface 24 requires cleaning, the yarn 23 is rapidly transferred to run in contact with the substitute surface 24' until such time as the reverse transfer is required. In this way machine down time is avoided. As a further alternative when the heater may be cleaned whilst at operating temperature, the yarn may be left running in contact with the surface 24, but run to waste if its quality is unacceptable due to the cleaning process.

An alternative embodiment of heater 18 for the same purpose as that shown in FIG. 2 is shown in FIG. 3. In this case the substitute surface 24' is disposed diametrically opposite to the surface 24. When the surface 24 requires cleaning, the heater 18 is rotated about its longitudinal axis 25 and the yarn 23 transferred from surface 24 to surface 24'. All of the above comments in relation to constructional arrangements of the cleaning device 22 and the heater 18 apply to the heater 33 the cooling plates 20, 21.

Figure 4:
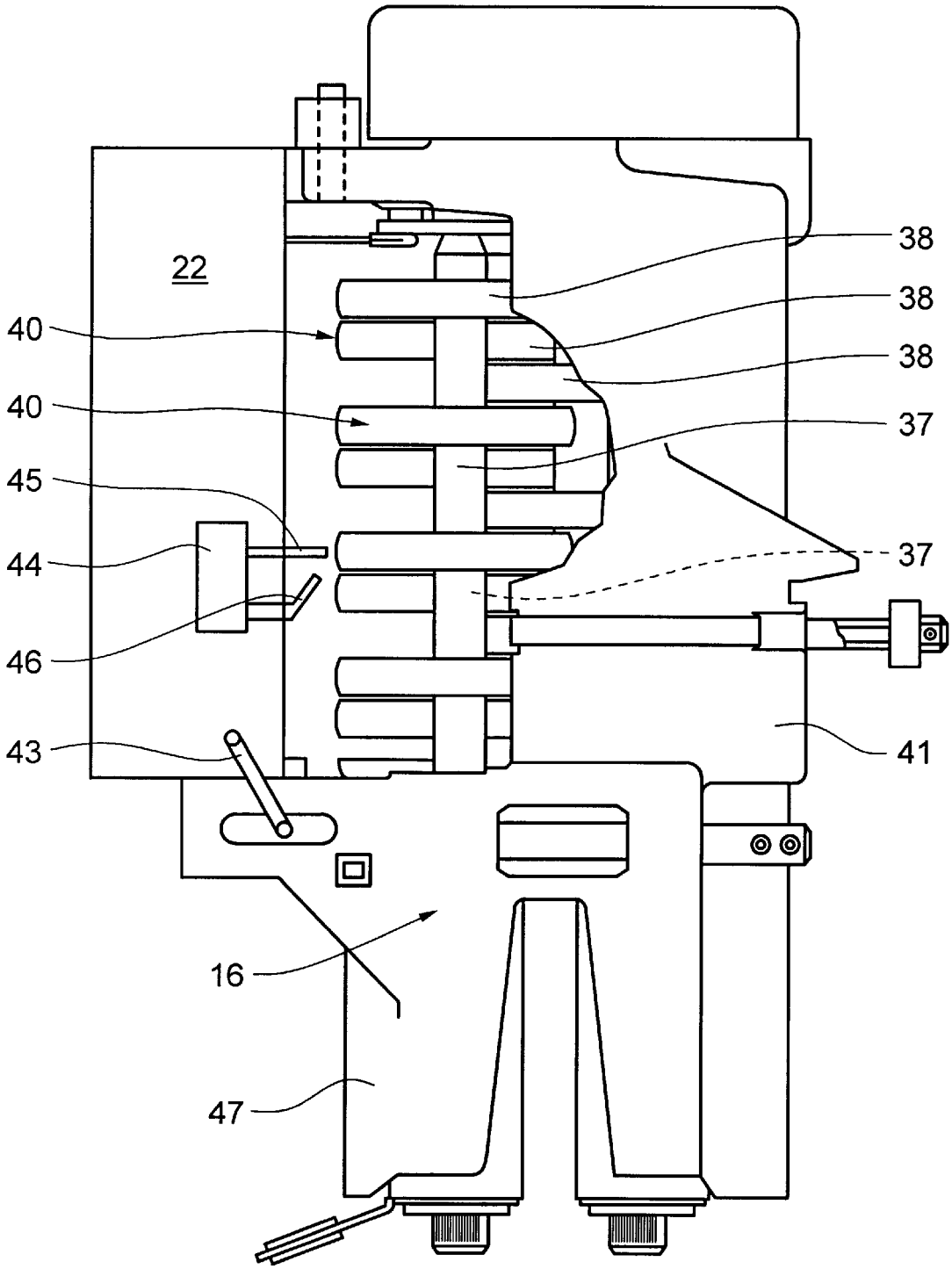
FIG. 4 is a view of a twisting unit of a machine and a cleaning device for the unit.

Referring now to FIG. 4, there is shown a false twisting device 16 which is mounted in the textile machine 10 by means of a base 47. The false twisting device 16 comprises three parallel spindles 37 on which are mounted the twisting discs 38. The yarn 23 runs over the peripheral surfaces 40 of the discs 38, which become glazed as the troughs in the surfaces 40 become filled with yarn debris. Currently the discs 38 are changed on the device 16, or the device as a whole is changed. In either case costly machine down time is involved. With the present arrangement, a cleaning device 22 is secured to the base 47 and top 39 of the device 16, and is positioned so as to direct the laser beam at the surfaces 40 of the discs 38 to clean them whilst running. The laser beam generator 44 is movable vertically in order that each of the surfaces 40 may be cleaned in turn. A fibre optic cable 45 extends near to the surface 40 being cleaned so as to accurately direct the laser beam at the surface 40. In addition, the twisting device 16 is enclosed in a casing 41 (shown partly cut away ) and cap 42 so as to reduce the risk to an operator from use of the laser cleaning device 22. Furthermore, the cleaning device 22 cannot operate unless it is secured to the machine 10 and the electrical supply is connected by cable 43. This reduces the risk of misuse of the cleaning device 22. In order that the debris removed from the surfaces 40 does not adhere to the end of the fibre optic cable 45, a jet of air is directed at the end of the fibre optic cable 45 by a blowing device 46.

Not only does the invention reduce or eliminate the down time of the textile machine 10 for cleaning purposes, but in addition there is the advantage that the cleaning arrangements described are more reliable than the brush and detergent methods used previously, and can be automated so as to increase the reliability even further.

What is claimed is:

1. A method of cleaning at least a part of a textile machine, comprising directing a laser beam at a part of said textile machine to clean the part of said textile machine.

2. The method according to claim 1, comprising directing the beam at the part to be cleaned while the part is disposed in the textile machine in its operating position.

3. The method according to claim 1, comprising operating the machine while effecting the cleaning of the part.

4. The method according to claim 1, comprising moving the part to be cleaned from an operating position to a cleaning position prior to directing the laser beam at the part.

5. The method according to claim 1, comprising directing the laser beam in a direction substantially perpendicular to a surface of the part to be cleaned.

6. The method according to claim 1, comprising moving at least one of the laser beam and a surface of the part to be cleaned relative to one anther.

7. The method according to claim 4, wherein said part to be cleaned is a first part, further comprising substituting a second part for the first part to be cleaned by moving the second part to the operating position when the first part to be cleaned is moved from the operating position to the cleaning position.

* * * * *